United States Patent [19]

Koh

[11] Patent Number: 4,959,036

[45] Date of Patent: Sep. 25, 1990

[54] DOLL ASSEMBLED OF PREFABRICATED WEAVE SECTIONS OF RUSH STALKS

[76] Inventor: Chang-Am Koh, Room No. 1107, 27-dong, Woosung Apt. 101-2, Jamsil-dong, Kangdong-ku, Seoul, Rep. of Korea

[21] Appl. No.: 584,919

[22] Filed: Feb. 29, 1984

[30] Foreign Application Priority Data

| | | | |
|---|---|---|---|
| Apr. 16, 1983 | [KR] | Rep. of Korea | 3429/83 |
| Jul. 15, 1983 | [KR] | Rep. of Korea | 6312/83 |
| Sep. 26, 1983 | [KR] | Rep. of Korea | 8344/83 |

[51] Int. Cl.[5] ..... A63H 3/36

[52] U.S. Cl. ..... 446/385

[58] Field of Search ..... 446/268, 369, 370, 385, 446/386

[56] References Cited

U.S. PATENT DOCUMENTS

| | | | |
|---|---|---|---|
| 1,300,915 | 4/1919 | Baum | 446/369 |
| 1,307,218 | 6/1919 | Spencer | 446/369 |
| 1,612,805 | 1/1927 | Francke | 446/385 |
| 1,640,260 | 8/1927 | Vogel | 446/268 |
| 1,678,226 | 7/1928 | Leigh | 446/385 |
| 1,730,177 | 10/1929 | Van Cleave | 446/385 X |
| 2,090,499 | 8/1937 | Gustafsson | 446/385 X |
| 2,249,335 | 7/1941 | Turner | 446/385 |
| 2,429,928 | 10/1947 | Exline | 446/321 |
| 2,636,318 | 4/1953 | Lock | 446/369 |
| 3,174,253 | 3/1965 | White | 446/368 |

FOREIGN PATENT DOCUMENTS

| | | | |
|---|---|---|---|
| 642576 | 8/1928 | France | 446/385 |
| 122100 | 11/1918 | United Kingdom | 446/385 |
| 399824 | 4/1933 | United Kingdom | 446/385 |
| 418713 | 10/1934 | United Kingdom | 446/385 |
| 1502941 | 3/1978 | United Kingdom | 446/385 |
| 2135204 | 8/1984 | United Kingdom | 446/385 |
| 2138307 | 10/1984 | United Kingdom | 446/385 |

OTHER PUBLICATIONS

Cornhusk Dolls, *Popular Mechanics,* Jan. 1963, pp. 164 & 165.

*Primary Examiner*—Mickey Yu
*Assistant Examiner*—D. Neal Muir
*Attorney, Agent, or Firm*—Antonelli, Terry & Wands

[57] ABSTRACT

A doll made of rush stalks assembled of prefabricated body sections comprising rusk stalk fabrics woven into a ball shape form or other body forms and a head section fitted into the body such that the doll makes best use of the original nature of rush stalks while providing the refinement of a fancy doll.

18 Claims, 4 Drawing Sheets

DOLL ASSEMBLED OF PREFABRICATED WEAVE SECTIONS OF RUSH STALKS

SUMMARY OF INVENTION

Present invention relates to a doll made of rush stalks, in particular, to a doll assembled of prefabricated body sections comprising rush stalk fabrics woven into a form of bell shape or into any other body forms and a known head section fitted into the body.

A purpose of a doll of rush stalk is to make the best use of the original nature of rush stalk to give it an indigenous appearance and craftsmanship.

In order to obtain the appearance of a doll having rush clothing, rush stalks had to be woven, tied, twisted to make a knot, or bound in a uniform bundle to form a body of the doll, which often resulted in absence of arms or required separate attachment of arms.

An object of the invention is not only to keep the characteristic nature of rush stalk but to gain a refinement of a fancy doll. According to the present invention, a body of the doll is woven into a bell form of plain weave interlacing warp threads and weft threads of rush stalks.

In another embodiment of the invention, the shoulder portion or the upper body portion of the doll is fabricated of rush stalk fabrics, of which thread strands are extended in prolongation and some of the threads being braided, twisted or bound in a bundle for arms and others being fabricated into any form of the lower body portion of the doll.

A separate head section of a known art shall be joined with the upper portion of the body directly or through mediation of a separate body section in-between for completion of the doll.

Figure 1:
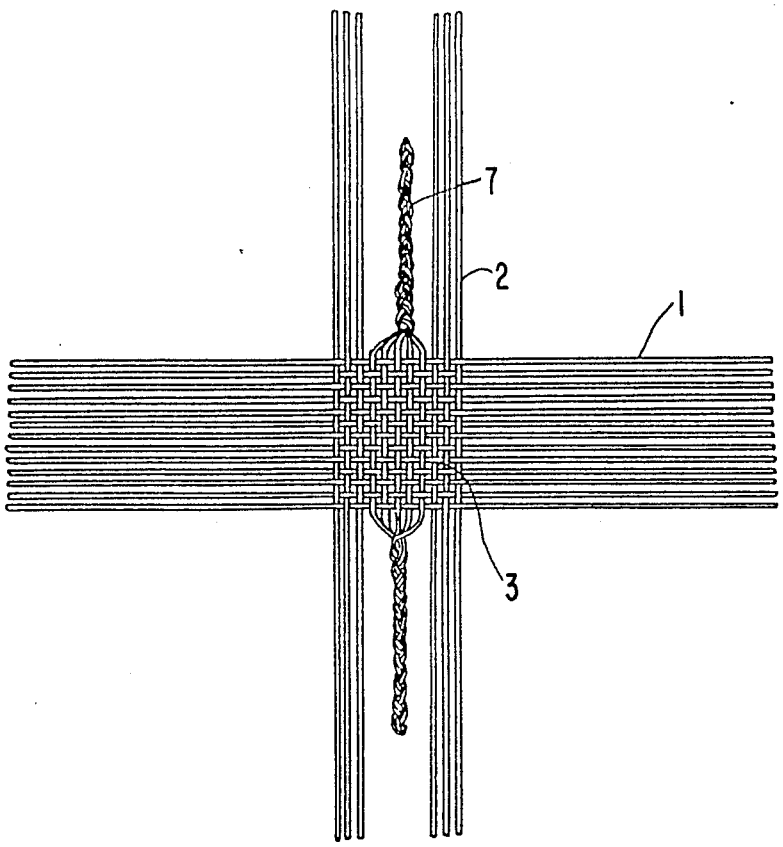
FIG. 1 shows a spread view of a plain weave portion of the invention.
Figure 2:
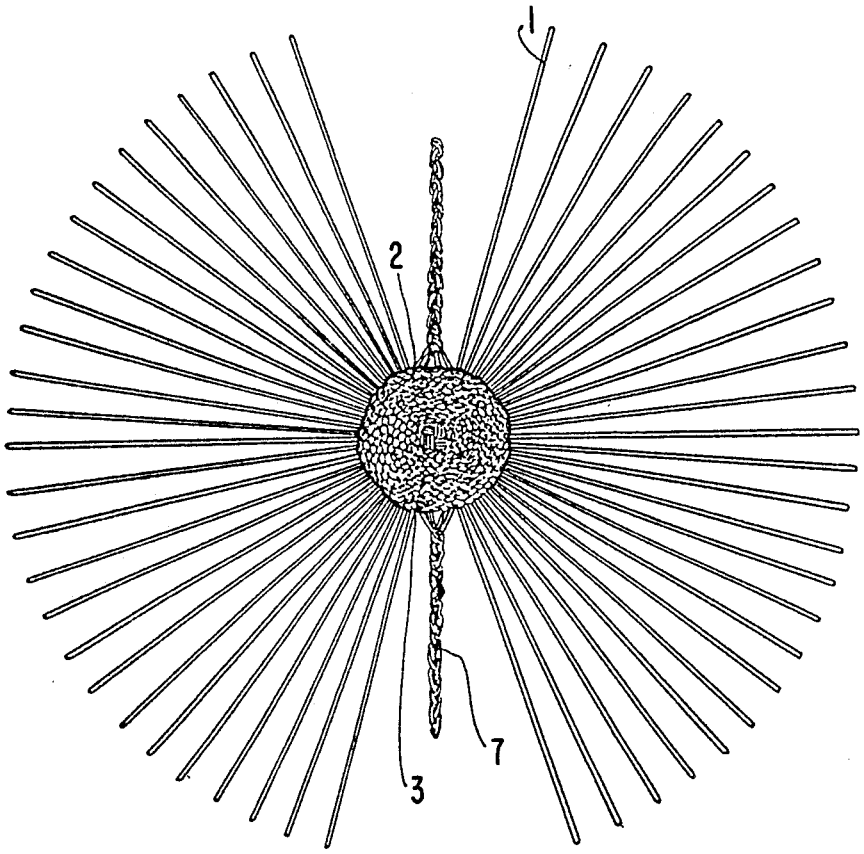
FIG. 2 shows a spread view of a vortex weave of the invention.

Numerals in the drawings indicate respectively the following, 1 indicating warp threads, 2 weft threads, 3 a weave portion, 4 an upper body portion, 5 a lower body portion, 6 a body section, 7 arms, and 8 a head section.

Referring to the drawing, the invention shall be described in details.

DETAILED DESCRIPTION OF INVENTION

According to the invention, a number of interlacing warp threads 1 and weft threads 2 are woven into a plain weave or a diagonal twill weave, or a vortex weave having warp threads 1 arranged radially from a center and weft threads 2 interlaced in a vortex wind from the center outward, to form a fabric portion 3, that constitutes a shoulder portion 4 or an upper body portion and has extended strands of warp and weft threads, some strands being braided, tied or twisted to make arms and others being woven or twisted, or drooped downward in a uniform arrangement, to form a lower body portion.

Figure 3:
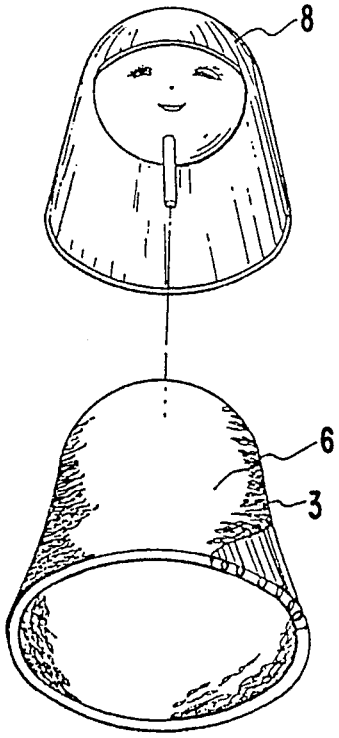
FIG. 3 shows a partially cut-away view in perspective of an embodiment of the invention.
Figure 4:
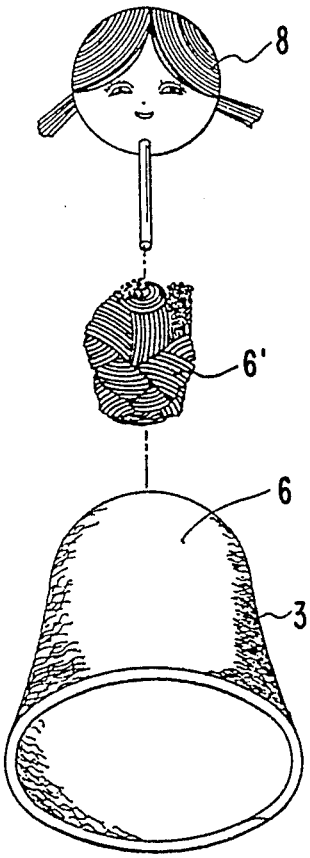
FIG. 4 shows partial body sections of an embodiment of the invention.
Figure 5:
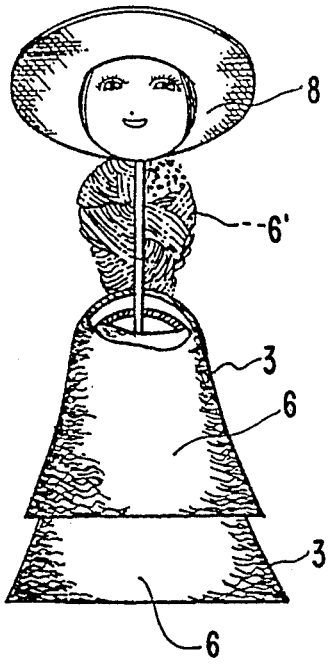
FIG. 5 shows a partially cut-away view in front of an embodiment of the invention.
Figure 6:
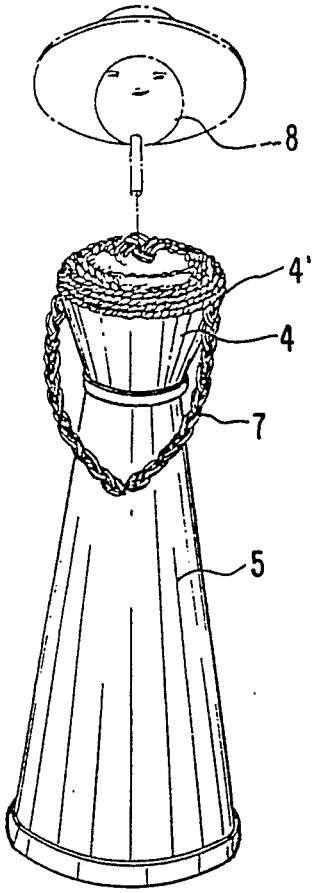
FIG. 6 shows a perspective view of another embodiment of the invention.

A separate head section is joined with the body at its top directly or by mediation of a separate body section in-between. In another embodiment of the invention, the warp threads 1 and the weft threads 2 of the fabric portion 3 are further woven to form a bell shaped body portion 6, as in the FIG. 3 and 4. Another embodiment of the invention as shown in FIG. 5 also shows a tiered skirt of a plurality of bell shaped skirts overlapped in a way of one over the other.

An advantage of the present invention is an improvement in quality and appearance achieved through the elaborate weaving of the fabric portion and through the best use of the characteristic nature of rush stalk, thus resulting in the elegance and refinement of the doll and upgrading the market value for the product.

Another advantage of the invention is the firm construction of the doll being so solid that it stands by itself without a support, thus enabling an easy fabrication of the doll and eliminating the risk of damage in the course of handling and transporting.

Another advantage of the invention is the integral construction of the body making the appearance so simple and neat that it gives a native and homely feeling characteristic of a farm country and presents a good use for decoration of tables and furnitures.

I claim:

1. An assembled rush stalk doll comprising a doll body having a shoulder portion or an upper portion formed of woven warp rush stalk threads and weft rush stalk threads, both the warp and weft rush stalk threads having extended strands, some of the strands formed into arms and other of the strands formed into other body portions in a desired shape, and a separate head section being fitted to the top of the doll body.

2. An assembled rush stalk doll according to claim 1, wherein some of the extended strands are plaited into arms and other are plaited, twisted, tied or drooped down straight in uniformity to form another portion of the doll body.

3. An assembled rush stalk doll according to claim 1, wherein the extended strands are further woven to form a bell shaped doll skirt.

4. An assembled rush stalk doll according to claim 1, wherein a plurality of bell shaped rush stalk skirts are overlapped to form a portion of said other portions of the doll body so as to have a tiered skirt appearance, and the separate head section is operatively joined with the doll body.

5. An assembled rush stalk doll comprising a shoulder portion of a body formed of warp rush stalk threads and weft rush stalk threads, said weft rush stalk threads forming arms and other body portions, and a head section fitted to the body.

6. An assembled rush stalk doll according to claim 5, wherein the threads are plaited.

7. An assembled rush stalk doll according to claim 5, wherein the threads formed into arms are plaited and the other threads formed into other body portions are twisted.

8. An assembled rush stalk doll according to claim 5, wherein the threads formed into arms are plaited and the other threads formed into other body portions are tied.

9. An assembled rush stalk doll according to claim 5, wherein the threads formed into arms are plaited and the other threads formed into other body portions are drooped down straight.

10. An assembled rush stalk doll according to claim 5, wherein the body is bell shaped.

11. An assembled rush stalk doll according to claim 5, wherein the body comprises bell shaped portions overlapping one another to form a tiered skirt.

12. An assembled rush stalk doll comprising an upper portion of a body formed of warp rush stalk threads and weft rush stalk threads, said weft rush stalk threads forming arms and other body portions, and a head section fitted to the body.

13. An assembled rush stalk doll according to claim 12, wherein the threads are plaited.

14. An assembled rush stalk doll according to claim 12, wherein the threads formed into arms are plaited and the other threads formed into other body portions are twisted.

15. An assembled rush stalk doll according to claim 15, wherein the threads formed into arms are plaited and the other threads formed into other body portions are tied.

16. An assembled rush stalk doll according to claim 12, wherein the threads formed into arms are plaited and the other threads formed into other body portions are drooped down straight.

17. An assembled rush stalk doll according to claim 12, wherein the body is bell shaped.

18. An assembled rush stalk doll according to claim 12, wherein the body comprises bell shaped portions overlapping one another to form a tiered skirt.

* * * * *